United States Patent [19]

Karpisek

[11] 3,937,605

[45] Feb. 10, 1976

[54] ROTARY PISTON MACHINE

[76] Inventor: Ladislav S. Karpisek, 121 Gannons Road, Caringbah, New South Wales, Australia

[22] Filed: Feb. 25, 1974

[21] Appl. No.: 445,348

[52] U.S. Cl. ..... 418/219; 123/8.29

[51] Int. Cl.[2] ..... F01C 19/08

[58] Field of Search ..... 418/211, 217, 219, 229, 418/230, 231

[56] References Cited

UNITED STATES PATENTS

| | | | |
|---|---|---|---|
| 420,347 | 1/1890 | Knebel et al. | 418/230 X |
| 761,512 | 5/1904 | Lecomte | 418/219 X |
| 1,042,215 | 10/1912 | Graf | 418/211 X |
| 1,686,767 | 10/1928 | Saxon | 418/219 X |
| 2,154,456 | 4/1939 | Knapp | 418/219 |
| 3,279,392 | 10/1966 | Conrad | 418/217 X |
| 3,762,841 | 10/1973 | Savikurki | 418/219 X |
| 3,819,309 | 6/1974 | Jacobs | 418/219 |

*Primary Examiner*—C. J. Husar
*Assistant Examiner*—Michael Koczo, Jr.
*Attorney, Agent, or Firm*—Eugene J. Kalil; James M. Rhodes, Jr.

[57] ABSTRACT

An energy converter comprising a housing, a cylindrical chamber in the housing, a shaft rotatably mounted in the housing and lying co-axial with the chamber, the ends of the chamber being complementarily profiled and of generally sinusoidal shape, a blade carrier fixed to the shaft and of thickness such that it bears on the crests of the profiles of the chamber ends thereby dividing the chamber into two zones one to each side of the blade carrier, at least one blade slidably mounted in the blade carrier with its ends respectively engaging the ends of the chamber, the blade extending reciprocating motion on the shaft rotated due to the cam action of the profiles on the blade and means to admit and exhaust fluid from the chamber zones to each side of the blade carrier.

12 Claims, 44 Drawing Figures

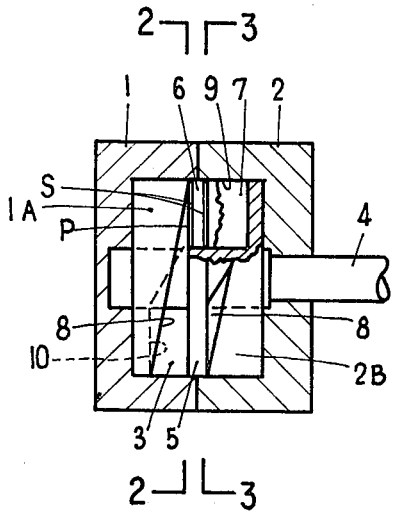
FIG. 1
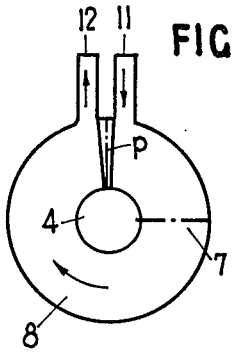
FIG. 2
FIG. 3
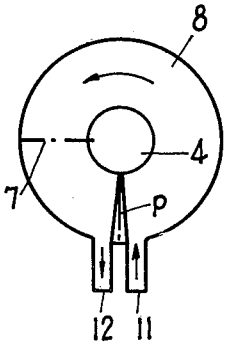
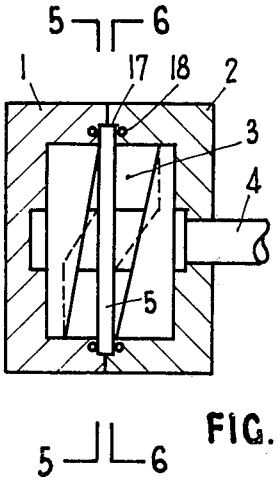
FIG. 4
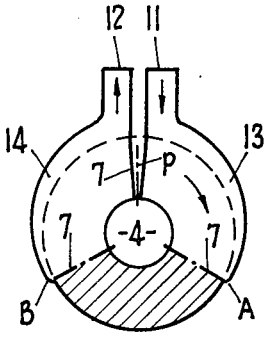
FIG. 5
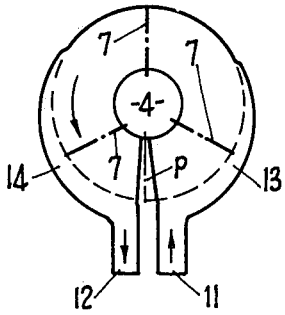
FIG. 6

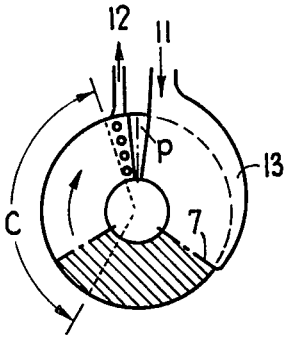
FIG. 14
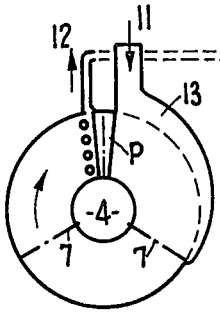
FIG. 15
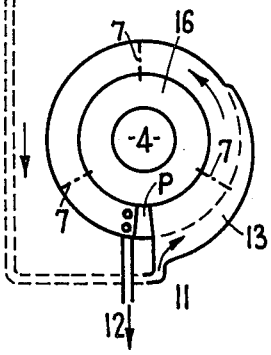
FIG. 16
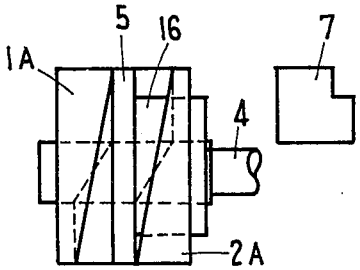
FIG. 17
FIG. 18
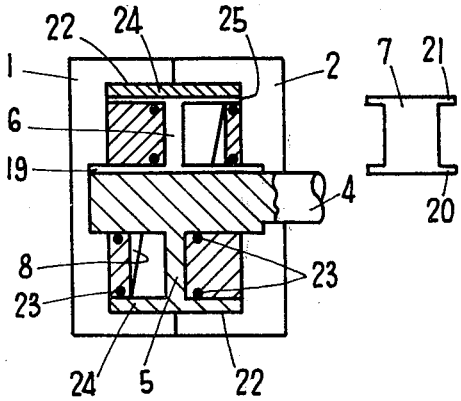
FIG. 19
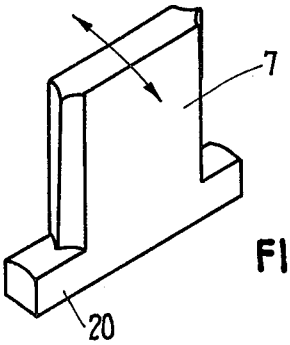
FIG. 20

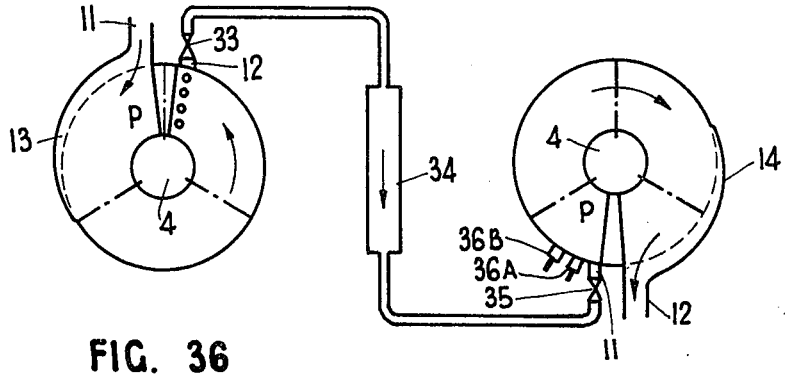
FIG. 36
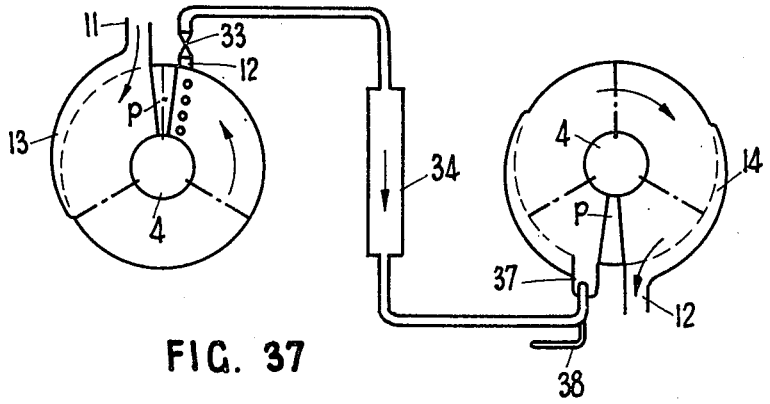
FIG. 37
FIG. 38
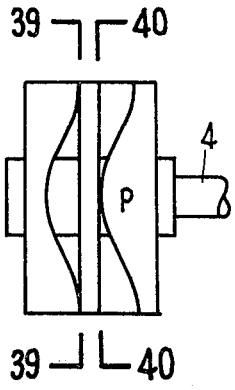
FIG. 39
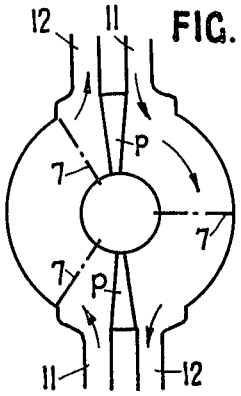
FIG. 40
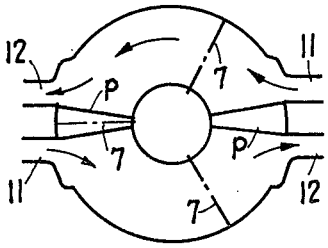

ROTARY PISTON MACHINE

This invention relates to machines which operate as energy converters, receiving energy in one form and converting it to energy in another form. The machine also falls into the category of machines which is loosely termed as the "Rotary Piston" type. Thus the machine may operate as a pump on which mechanically provided energy is expended and the energy possessed by a flow of pressurised fluid results, or it may be a fluid motor, receiving energy in the form of pressurised fluid which does work to achieve mechanical movement. In a particular form it may also provide mechanical movement as a result of releasing the latent energy of chemical compounds as occurs, for example, in the operation of an internal combustion engine. All of the foregoing examples of the machine will be dealt with in detail hereinafter.

Broadly, there is provided, according to the invention, an energy converter comprising a blade assembly rotatable in a substantially cylindrical chamber in a housing, said blade assembly comprising a shaft with a uniform thickness radially extending blade carrying disc located intermediate the shaft ends, at least one slot through said blade carrier in the direction of the axis of the shaft, a blade slidably mounted in said slot, said blade being of uniform thickness and of generally rectangular configuration with two sides, two edges and two ends, the blade length from end to end exceeding the thickness of the blade carrier, said chamber having a pair of oppositely located ends which are complementarily profiled and have central openings to respectively accept the portions of said shaft to either side of the blade carrier, the profile of each of said chamber ends is generally sinusoidal with an equal number of peaks and valleys and with the distance between the chamber ends substantially equal to the length of said blade and the distance between the peaks on the respective chamber ends in the axial direction of the shaft substantially the same as the thickness of the blade carrier, the ends of the blade lying at right angles to the shaft axis and intimately engaging the profiled surfaces of the chamber ends, one (the inner edge) of the blade engaging the peripheral surface of the shaft and the other (the outer edge) of the blades engaging the cylindrical chamber surface so that as said shaft rotates said blade is caused to oscillate in the axial direction of the shaft due to sealing end engagement of the blade with the profiled chamber ends and with the edges of the blade respectively sealing against the periphery of the shaft and the cylindrical wall of the chamber and with the sides of the blade sealing against the sides of the slot through the blade carrier, there being inlet and outlet ports to the chamber zones to each side of the blade carrier.

Several embodiments of the invention are described with reference to the accompanying drawings in which:

FIG. 1 is a diagrammatic illustration, partly in section of the simplest form of the invention.

FIG. 2 is a view in the direction 2—2 of FIG. 1.

FIG. 3 is a view similar to FIG. 2 but in the direction 3—3 of FIG. 1.

FIG. 4 is a diagrammatic illustration similar to FIG. 1 with the blade removed and showing a method of sealing the blade carrier.

FIG. 5 is a view in the direction of 5—5 of FIG. 4 showing inlet and outlet porting for a three blade embodiment of the invention.

FIG. 6 is a view similar to FIG. 5 but in the direction of 6—6 FIG. 4.

Figure 13:
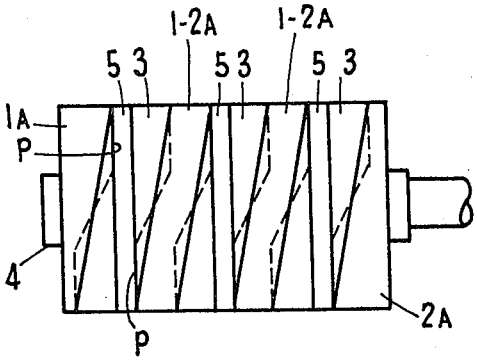

FIG. 13 diagrammatically illustrates a blade carrier and chamber ends for a multi-compartment version of the machine of FIG. 1.

FIG. 14 is a view similar to FIG. 5 showing the outlet porting for an air compressor version of the machine of FIG. 1 indicating maximum volume and maximum compression positions of the blades.

FIG. 15 and FIG. 16 diagrammatically illustrate two interconnected zones of a two-stage air compressor.

Figure 10:
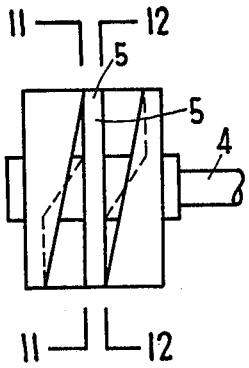
FIGS. 10 to 12 are views similar to FIGS. 4 to 6 but showing another type of inlet porting.

FIG. 17 is a view similar to FIG. 10 showing the features of the blade carrier of a two-stage compressor of the type illustrated in FIGS. 15 and 16.

FIG. 18 is a side view of a blade for use in the FIG. 17 construction.

FIG. 19 is a diagrammatic view similar to FIG. 1 showing means to increase blade support for high pressure machines and a blade for use in such high pressure machines.

FIG. 20 is a perspective view of one form of blade.

FIGS. 21 to 24 and 26 to 28 are views similar to FIG. 20 showing other forms of blade.

Figure 25:
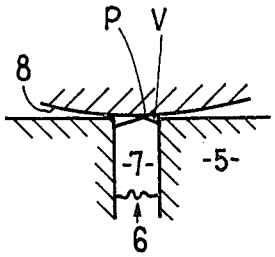

FIG. 25 is fragmentary view of a blade end to chamber end peak engagement.

Figure 29:
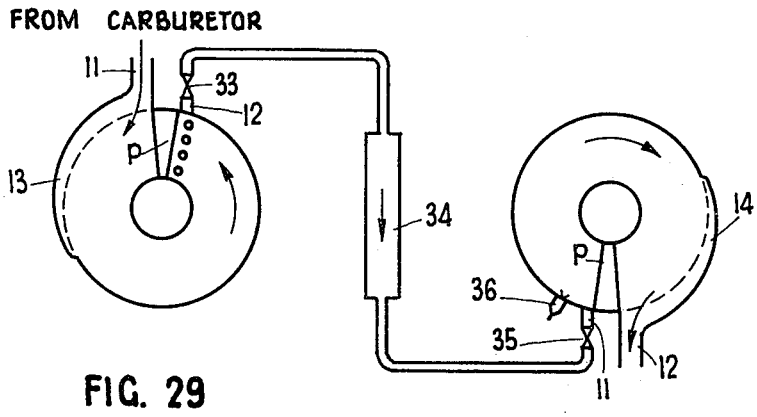
Figure 30:
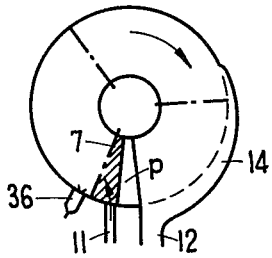

FIG. 29 is a diagrammatic illustration of a carburetor type spark ignition engine.

FIGS. 30 to 35 show various stages in the burn-expand-exhaust operation of the engine of FIG. 29.

FIG. 36 is a view similar to FIG. 29 but of a fuel injection type engine.

FIG. 37 is a view similar to FIG. 29 but of a continuous-burn type engine.

FIGS. 38 to 40 are views similar to FIGS. 4 to 6 of a four zone pump with three blades.

Figure 44:
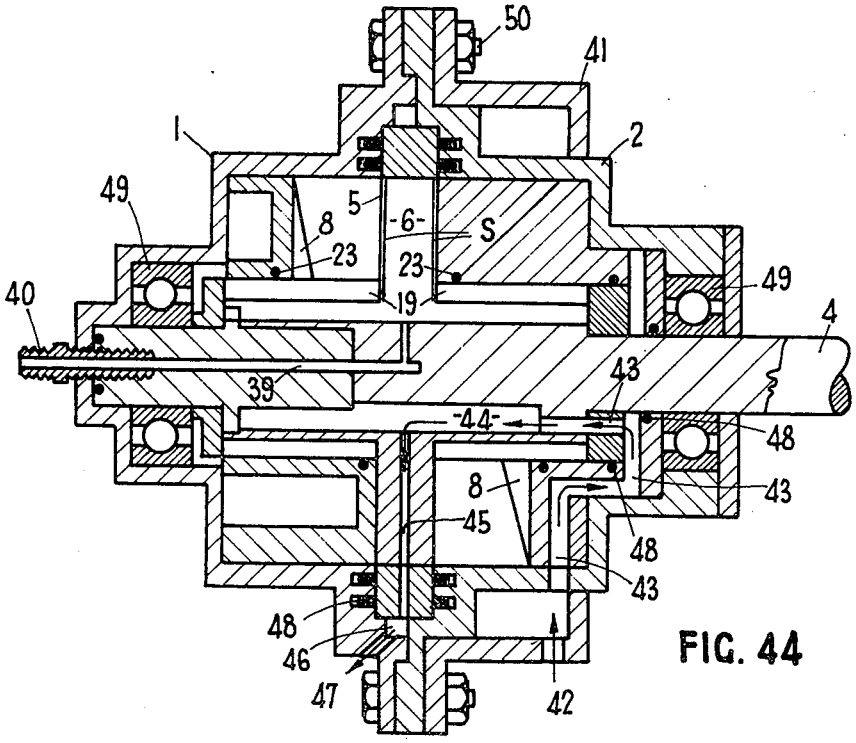
Figure 41:
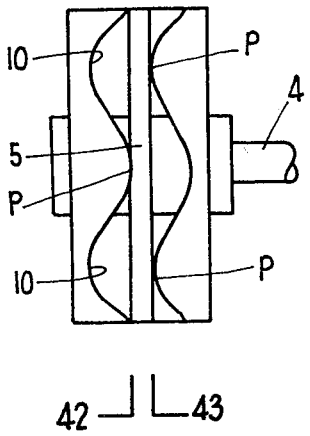
Figure 42:
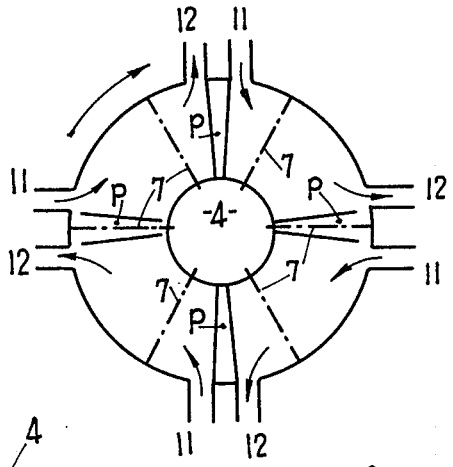
Figure 43:
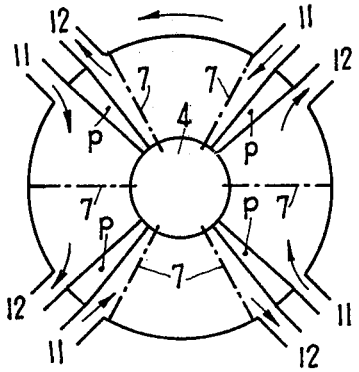

FIGS. 41 to 43 are views similar to FIGS. 38 to 40 of an eight zone pump with six blades and FIG. 44 is a simplified cross-sectional view of a machine according to the invention and incorporating refinements which distinguish it from the FIG. 1 embodiment.

The basic and simplest form of the machine is illustrated in FIGS. 1 to 3 and comprises a housing of two parts, 1 and 2 having an internal generally cylindrical chamber 3 in which is housed a rotating blade assembly which includes a shaft 4 which passes through the chamber 3 and is rotatably supported by the housing parts 1 and 2.

Specifically, the blade assembly comprises, a blade carrying disc 5 fixed to or integral with the shaft 4. The disc 5 has a radial through-slot 6 and a single blade 7 of generally rectangular shape and section is slidably mounted in the slot 6. For convenience the blade 7 is shown broken so that a side of the slot 6 can be shown and identified. The slot 6 may be provided with a sealing means S to engage the sides of the blade 7 to seal the chamber zone on one side of the blade carrying disc 5 from the chamber zone on the other side of the blade carrying disc 5.

The chamber 3 is bounded by the cylindrical chamber wall 9 and by two complementarily profiled faces 8 of two members 1A and 2B fixed in the body parts 1 and 2, the profiled faces 8 are at a constant spacing equal to the length of the blade 7. The profile of each end 8 is generally sinusoidal and provides a single peak P and a single trough 10 and is regular in that one half length of each profile complements the other half length of that profile.

Both ends 8 at all points along their length are radial with respect to the shaft 4, so that at all times there is full radial engagement of the respective ends of the rectangular shaped blade 7 with the chamber ends 8. The single peaks P of the respective ends 8 are 180° out of phase, as specified above, and are also spaced apart in the axial direction of shaft 4 by a distance such that the peaks P are in rubbing engagement with the respective sides of the disc 5. It follows that as the shaft 4 rotates it is restrained against axial movement by the engagement of the peaks P with the sides of the disc 5, and the blade 7 will slide to and fro in the direction of the axis of the shaft 4 due to the cam action of the profiles of the ends 8 on the ends of the blade 7.

Referring now to FIG. 2 which is a section on line 2—2 of FIG. 1. The shaft 4 is shown rotated 90° from a zero or datum location where the blade would be aligned with the peak P, inlet and outlet ports 11 and 12 respectively are provided to admit and exhaust fluid from the machine chamber 3. It will be seen that as the shaft 4 moves clockwise and the end of the blade 7 moves away from the peak P of the chamber end 8 a zone of negative pressure is created between the trailing side of the blade 7 and the line of sealing between the peak P of the chamber end 8 and the side of the disc 5. When the blade 7 proceeds beyond the inlet 11 fluid will be sucked into the zone of negative pressure through the inlet 11. The zone will continue to increase in volume as the shaft 4 rotates. It is to be noted that with a single blade 7 there will be direct communication between ports 11 and 12 for a period of time sufficient for the blade 7 to pass from just uncovering the port 12 to a point just beyond the port 11. Once the blade 7 goes beyond the inlet 11 it is cut-off from the outlet 12 and there is a positive displacing force applied to the fluid in front of the blade 7 so as to discharge that fluid through the port 12. Naturally as the blade 7 advances beyond the port 11 towards port 12 to discharge the fluid in front of it, a new negative pressure zone is being formed behind the blade into which fresh fluid is drawn through port 11.

The short period when the ports 11 and 12 are in direct communication could result in a back-flow of fluid, if the discharge from port 12 is against a head or like back-pressure, for this reason the pump in this simple one blade form has limitations of performance.

What has been described is one half of the pump, that is, what is happening in a zone to one side of the disc 5. A similar sequence of events is happening in the other zone on the other side of the disc 5, using a second set of inlet and outlet ports, 11 and 12 (see FIG. 3). The ports 11—11 and 12—12 of the two sides of the disc 5 can be interconnected so as to provide a single inlet line and single outlet line for the fluid.

It follows that with two blades 7 one of the blades will provide a positive barrier to back-flow through the pump as at no time are the inlet and outlet ports directly interconnected. They are always separated either by one or both blades 7, or before blade and by the line of contact of the peak P on the chamber end 8 with the side of the disc 5.

It is considered that three blades is a suitable number of blades for a pump. FIGS. 5 and 6 illustrate schematically a three blade arrangement with the maximum volume being hatched and location symmetrically with respect to trough 10. An included angle of 360/3 = 120° exists between the blades. The blades are shown dotted in a zero or datum position with one blade on the peak P.

If incompressible liquid is being considered liquid transference without any compressive loads on the liquid is essential. The ports 11 and 12 must be extended in a multi-blade arrangement as illustrated and identified 13 and 14 respectively. As one blade 7 passes point B, thereby enabling out-flow along port extension 14 to commence the other blade 7 passes point A preventing any further inflow along port extension 13. Again, the illustration is of one side of the pump, a like sequence of events is occurring 180° out of phase from the situation illustrated in FIG. 6 and this is shown in FIG. 5.

Figure 7:
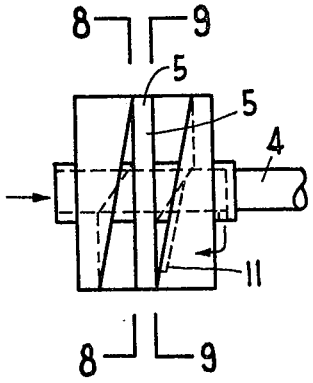
FIGS. 7, 8 and 9 are views similar to FIGS. 4 to 6 but showing a different type of inlet porting.
Figure 8:
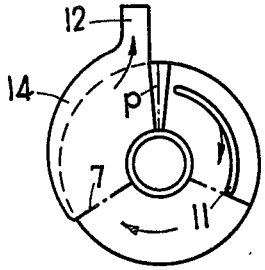
Figure 9:
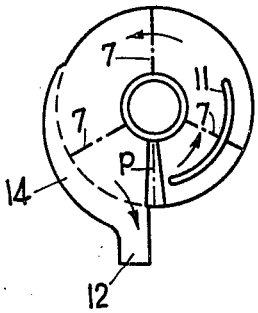

FIGS. 7, 8 and 9 show a possible porting system for pumps in that the shaft 4 is hollow and it follows from FIG. 7 that fluid may flow as shown by the arrows into the chamber zones to either side of the disc 5 through ports 11 and exit through ports 12. The two ports 12 may be combined to a single outlet. FIGS. 8 and 9 are views in the direction lines 8—8 and 9—9 of FIG. 7.

Figure 11:
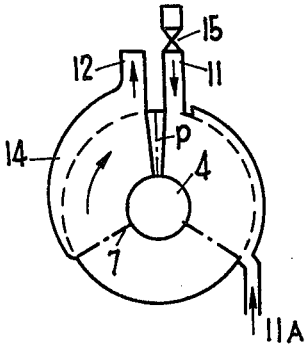
Figure 12:
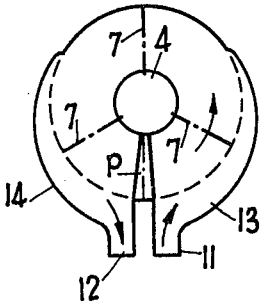

All of the embodiments just described have utilised a drive shaft 4 but it is possible to utilise pressurized fluid to rotate the disc 5 and the blades 7 mounted therein. Referring now to FIGS. 10, 11 and 12, a one-way valve 15 (shown diagrammatically) in FIG. 10 is located in port 11 to a zone of the chamber and an additional inlet port **11*a* is also provided through which pressurized fluid is admitted. The port 11*a* is preferably adjustable to permit inflow of the pressurized driving fluid at positions from adjacent port 11 to the port indicated 11*a*. In this way the amount of driving fluid admitted to the zone can be controlled. The one-way valve prevents a back-flow of pressurized fluid out of port 11**.

As illustrated the admission of pressurized fluid is limited to one side of the disc 5. If required both sides may be similarly equipped with additional ports **11*a***.

It is to be noted that FIG. 10 illustrates the shaft 4 extending beyond the pump body. The shaft 4 is not used as a driver in the embodiment just described, however with the same porting arrangement and the shaft 4 driven, an accurate and reliable liquid mixing pump is provided. Different liquids could, for example, be fed through ports 11 and **11*a*** and such a pump would be ideally suited for diluting concentrates, chemicals or acids.

If pumping capacity in excess of that possible from a unit as just described is required ganged pump units as illustrated in FIG. 13 may be used. In FIG. 13 there are three chambers 3 and chamber ends 1A and 2A and intermediate profiled spaces. It also follows that should one unit of the pump of FIG. 13 be coupled to pressurized liquid there would be no need for an external motive means to rotate the shaft 4, one unit would provide the drive to cause the other units to act as pumping means.

The basic construction of the liquid pump embodiments just described applies to gases. Thus the machine can operate satisfactorily as a compressor. Variations in porting are required so that prior to exhaust a degree of compression of the gas takes place. Referring to FIG. 14 the outlet is located so that the maximum volume (represented by the shaded area in FIG. 14) is compressed into the volume within the arc C of FIG. 14. It is to be noted that although the arc C still covers 120° the volume is considerably less than that shown shaded, due to the end of the chamber in the arc C being inclined upwardly toward the profile peak P, a ratio of up to 10:1 is easily achieved. Should further compression be desired the form of the machine makes multistaging very simple as is shown in FIGS. 15 to 17. The compressed gas is discharged from the zone to one side of the disc 5 (FIG. 15) to the zone to the second side of the disc 5 (FIG. 16) which is volumetrically inferior to the first side. This is achieved by providing a boss 16 on the disc 5 which affectively reduces the volume of the chamber zone on the second side of the disc 5. It follows that if 10:1 compression occurs on the first side of the disc 5, reducing say 100 ccs to 10 ccs, then the 10 ccs when compressed at 10:1 on the second side of the disc 5 will become 1 cc. In two stages therefore a compression ratio of 100:1 is achieved. The compressed air would be stored in a receiver ready for use. A one-way valve may be used at each exhaust port 12 if desired.

In the event that the machine is to be used for high pressure operation or where sealing is critical it would be possible to provide the blades 7 with features as illustrated in FIG. 4, one such feature is a peripheral groove 17, in the chamber cylindrical wall, the blade disc 5 is of sufficient diameter to enter the groove and seals 18 may be included as indicated to seal the clearance between the sides of the disc 5 to the sides of groove 17. Referring now to FIG. 19 the shaft 4 may also be grooved as at 19 to provide a slideway for the blades 7. Additionally the blade ends may have extensions 20 which are housed in the shaft bearings. The blades may also have end extensions 21 adjacent the cylindrical chamber wall and these and the outer blade edge are received in axial grooves 25 in an annular rim 24 of the blade carrier. The rim being housed in annular recesses 22 in the chamber ends.

Seals 23 may be provided to seal the clearances between the adjacent surfaces of the blade extensions 20 and 21 and the shaft bearings and the annular recesses 22 respectively. Preferably the seals are located in grooves of profile similar to the profile of chamber ends 8.

Figure 21:
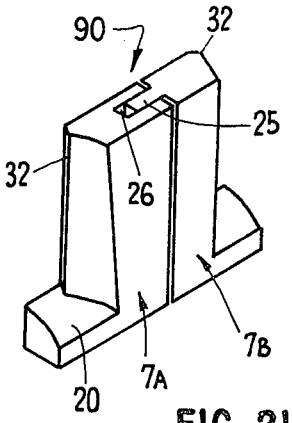
Figure 22:
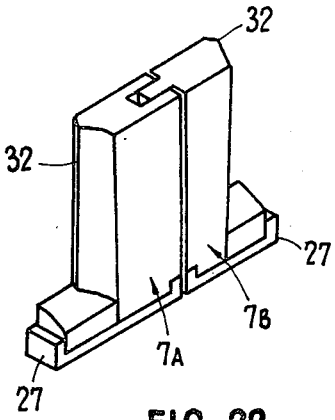
Figure 23:
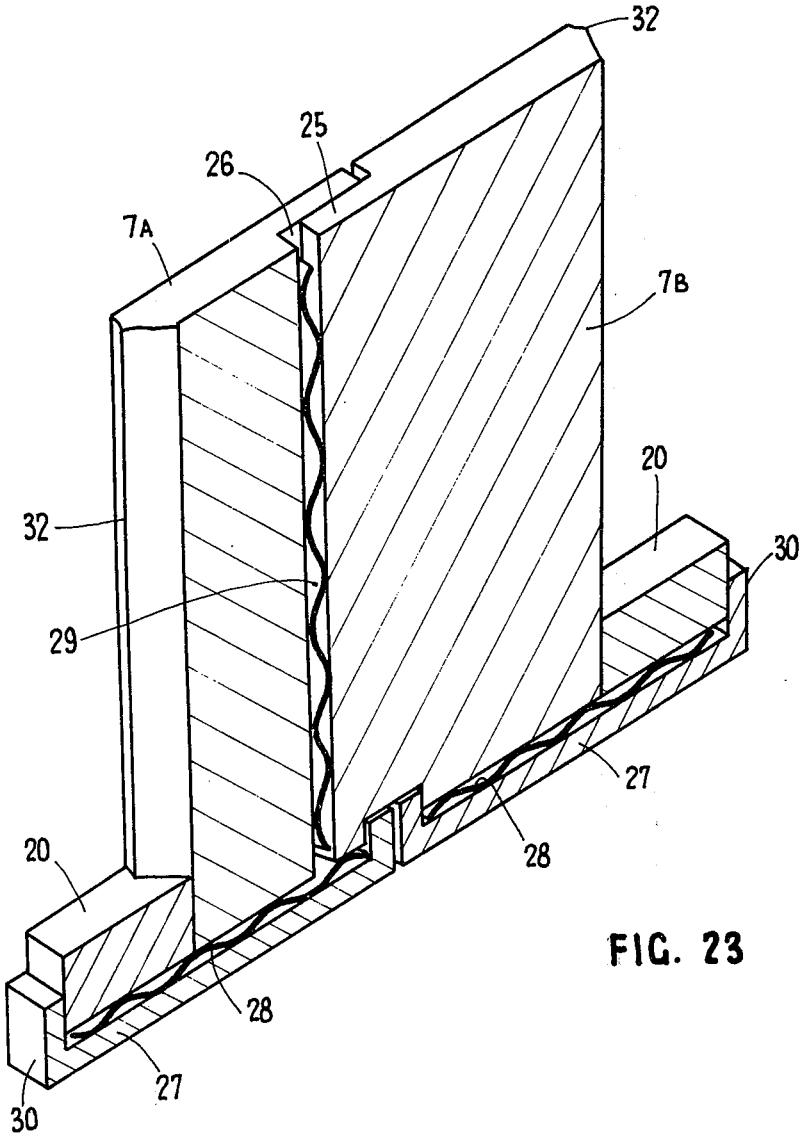

The sealing of the blade ends and edges can be accomplished in numerous ways. It is presently preferred that the blade is made in parts, see FIGS. 21 to 24 and 26 to 28 which illustrate various blade shapes involving a plurality of parts. In FIG. 20 the blade is solid. In FIG. 21 the blade is split as at 90 with a tongue 25 on one blade part slidable in a groove 26 in the other blade part. Preferably some form of seal is used to seal the sides of the tongue 25 against the sides of the groove 26. The extensions 20 of the blade 7 are integral with the blade parts 7*a* and 7*b*. FIG. 22 shows a variation in which a slipper 27 is provided for each blade part. Springs may be placed between the slipper 27 and its associated blade part to urge the outer edge of the blade parts against the cylindrical surface of the chamber. Such spring means being more clearly illustrated in FIG. 23 and identified 28. A leaf spring of wave form is shown, but alternative forms of spring or a resilient pad may be used. FIG. 23 also shows a like spring 29 to urge the blade parts apart to ensure good sealing contact of the blade ends 32 with the chamber ends 8.

FIG. 23 also illustrates a further modification in that the blade extensions 20 are separate blocks retained between the ends of the blade and a lip 30 on each slipper 27.

Figure 24:
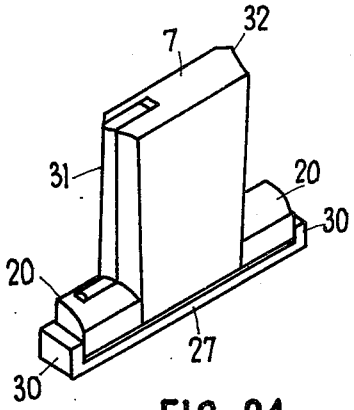
Figure 26:
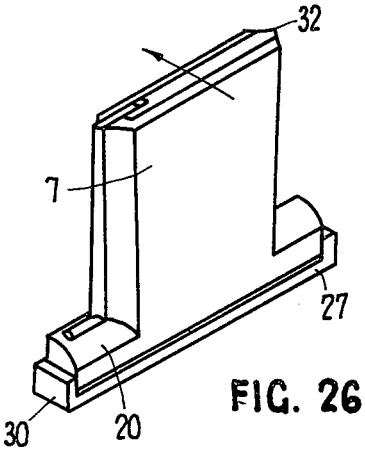

It is possible to use a configuration as shown in FIG. 24 wherein a single sub-blade 31 is housed in a groove in the blade, the sub-blade 31 being biassed outwardly by spring means, (not shown), but preferably similar to spring means 28.

It is to be noted that in several of the Figures that the crest 32 on the blade ends, which is the sealing line of the blade ends with the chamber ends, is not central with respect to the blade thickness. This is purposely the case to avoid loss of efficiency in compression cycles. This is clear from a study of FIG. 25 which is an enlarged fragmentary view of the situation occurring when the end of the blade 7 withdraws into the blade carrier slot 6 and as the blade crest 32 passes over the peak P of a chamber end profile. The volume *v* of the triangular space bounded by part of the profile, the short angled side adjacent peak 32 and the side of the groove 6 will carry forward with the blade, this volume would be nil in the situation where the blade crest 32 occurred at the leading side of the blade, but for practical reasons this construction is not desirable. It follows that as the blade crest 32 becomes more central with respect to the blade the volume *v* carried forward and not exhausted will increase.

Figure 27:
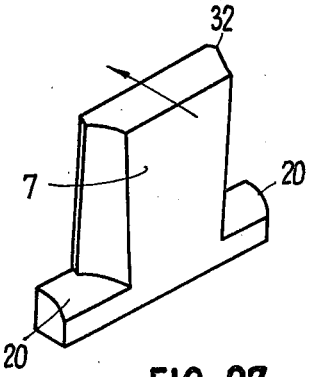

The FIG. 20 construction provides the opportunity to rotate the blade carrier in both directions whereas the FIG. 27 construction (for example) is for practical reasons limited for best efficiency to rotation in the direction of the arrow.

Figure 28:
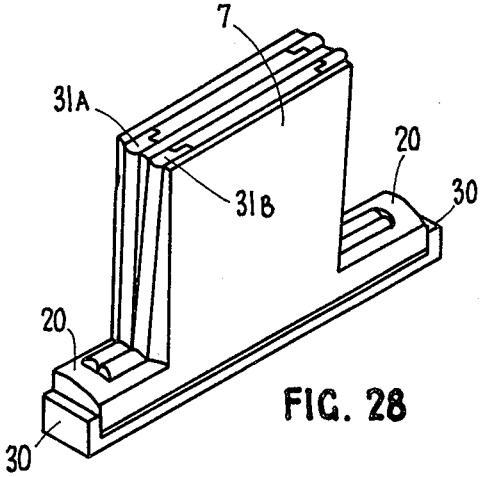

Variation may be adopted in the blading for example see FIG. 28 where twin sub-blades 31 are used, with one sub-blade 31*a* acting as a compression blade and the other 31*b* acting as an oil scraper blade to remove oil which can be pumped into the space between the sub-blades to lubricate the mating portions of the blade end and chamber end.

A natural progression from the compression is to an engine which may be one of several types. Examples would be spark ignition or compression ignition of a fuel-air mixture. Another would include an air compression stage and diesel fuel would be injected thereinto resulting in pressure ignition, another form would involve petrol injection into compressed air with associated ignition means.

An engine according to the invention is described with reference to FIGS. 29 to 35 which schematically represent an engine having spark ignition for a fuel-air mixture.

In FIG. 29 (where no blades are shown) air-fuel mixture is taken in and compressed in a zone to one side of the blade carrier and exhausted through a one-way valve 33 into a receiver 34 from whence the compressed gas passes into the ignition and expansion zones of the machine on the other side of the blade carrier through one-way valve 35. The valve 33 prevents back-flow of gases into the compression zone when pressure there drops below the pressure of the gas in the receiver 34 and the valve 35 prevents a back-flow into the receiver 34 as the pressure in the combustion zone builds up above that of the gas in the receiver. The pressure relationship also regulates the amount of mixture able to enter the combustion zone through valve 35. The valve 35 also acts as a safeguard against flash-back of flame from the combustion zone which could ignite the gases in the receiver.

Figure 31:
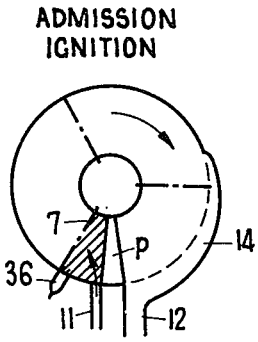
Figure 32:
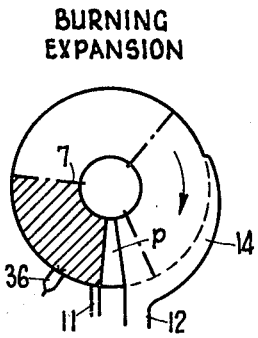
Figure 33:
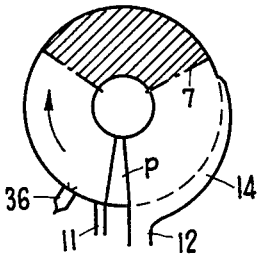
Figure 34:
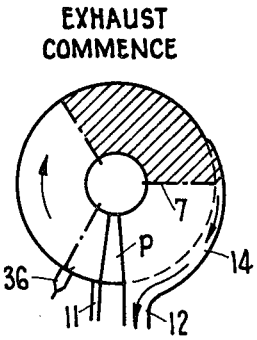
Figure 35:
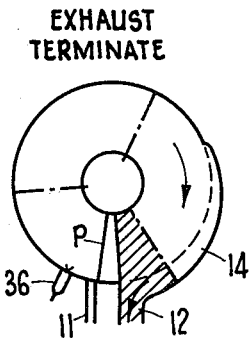

Assuming a compressed mixture of air and fuel from the receiver is fed into the area between the blade 7 and the profile peak P (see FIG. 30), on the blade reaching a position shown in FIG. 31 beyond the inlet port 11 leading into the combustion zone a spark plug 36 is uncovered and fired to ignite the mixture to generate a force behind the blade 7 thereby rotating the shaft 4 in a direction of the arrow.

The subsequent sequence of actions is illustrated in FIGS. 32 to 35.

Another possible mode of operation is illustrated in FIG. 36 which illustrates schematically a diesel arrangement in which fuel is injected into highly compressed air for pressure ignition by injector 36A. Alternatively injection of fuel e.g. kerosene or petrol by injector 36B into less highly compressed air in the presence of an ignition means to promote combustion. The ignition and injection timing for the spark plug and fuel injection is achieved in any suitable way.

FIG. 37 illustrates a continuous burning arrangement, in effect a hot gas engine. Compressed air from outlet 12 goes to receiver 34 and is delivered to burner 37 where it is mixed with fuel from fuel line 38. Combustion continues in burner 37 with an excess of air ensuring complete combustion of the fuel. The hot gas applies a driving force to blades 7 to cause shaft 4 to rotate.

In all of the foregoing the receiver 34 serves to even out any pulsing in the air supply to the subsequent operations, such pulsing arising from the manner of the air compressions in the compression zone of the machine.

The machine may also have a multi-peak profile chamber end. Referring to FIGS. 38 to 40 the chamber ends 8 have two peaks P and two troughs 10. Three blades are used and there is thus two zones to each side of the blade carrier 5 instead of one as hereinbefore described.

Referring to FIGS. 41 to 43 there is illustrated a four peak profile for each end 8 thus an eight zone machine is provided. For efficient running a number of blades in excess of the number of peaks on each end wall is preferred.

The foregoing examples of engines have not dealt with basic problems such as cooling or lubricating the engine components. Because of the nature of the machine such problems are relatively easy to solve.

Referring now to FIG. 44 which is a cross-sectional view of a basic engine, but from which such things as the blades, carburettors, ignition means and exhaust and inlet manifolds have been omitted in the interest of simplicity.

The shaft 4 is hollow having an axial passageway 39 through which oil will pass from inlet coupling 40 to oil galleries which would then distribute oil to the required area. Some examples being between the blades and the surfaces on which they bear. As illustrated the housing part 2 has an affixed water jacket 41 which, like the housing is stationary, water would enter through port 42, pass through channels 43 into reservoir 44 and by centrifugal force water is circulated through radial holes 45 in the blade carrier to gallery 46 and outlet port 47. Water seals 48 are used as required.

Referring now to other features of the FIG. 44 construction, the shaft is mounted in bearings 49 in housing parts 1 and 2 bolted together at with the water jacket 41 by bolts 50.

I claim:

1. In an energy converter including a blade assembly rotatable in a substantially cylindrical chamber defined within a housing; said blade assembly comprising a shaft having a generally uniform diameter along the axial length thereof, a radially extending blade carrying disc having a diameter greater than the diameter of the substantially cylindrical chamber defined by the housing, said blade carrying disc being deposed intermediate the terminal ends of said shaft, a peripheral groove formed in the cylindrical chamber wall of the housing defining said generally cylindrical chamber, said peripheral groove being generally circumferential with respect to the blade carrying disc, said blade carrying disc extending radially into said peripheral groove, at least one slot being formed axially through said blade carrying disc and terminating radially inwardly of the periphery of said disc, a blade being slidably mounted in said slot, said blade including a generally uniform thickness and a generally rectangular configuration described by two sides, two edges and two ends, the length of said blade from one end to the other end being sized to exceed the thickness of said blade carrying disc, said generally cylindrical chamber being at least partially defined by a pair of opposed faced radially extending end walls which are complementarily profiled and formed with centrally disposed recesses for receiving the terminal ends of said shaft axially projecting from either side of said blade carrying disc, the profile of each of said chamber end walls being generally sinusoidal in configuration with equal numbers of peaks and valleys and with the distance between the chamber end walls substantially equal to the length of said blade, and the axial distance between said peaks on the respective chamber and walls being substantially equal to the thickness of said blade carrying disc, the ends of said blade being positioned at a right angle to the shaft axis and engaging the profiled surfaces of said chamber end walls, the inner edge of said blade being positioned to engage the cylindrical surface of said shaft and the outer edge of said blades engaging the cylindrical wall of the housing defining said generally cylindrical chamber, said blade being caused to reciprocate in the axial direction of the shaft in response to rotation of said shaft and the sliding engagement of said blade with the profiled chamber end walls, sealing means being provided for sealing the edges of said blade with respect to the circumferential surfaces of said shaft and of said cylindrical wall defining said generally cylindrical chamber, further sealing means being provided for sealing the sides of said blade with respect to the sides of said slot formed in said blade carrying disc, and an inlet port and an outlet port communicating with the chamber zones defined on either side of said blade carrying disc.

2. An energy converter as claimed in claim 1, including sealing means disposed in said peripheral groove for sealingly engaging that portion of said blade carrying disc extending radially into said groove.

3. An energy converter as claimed in claim 1, wherein at least two blades are mounted in said blade carrier.

4. An energy converter as claimed in claim 1, including sealing means fixed to said blade ends for sealingly engaging the profiled surfaces of said chamber end walls.

5. An energy converter as claimed in claim 1, wherein each of said blades comprises at least two parts, and said parts are urged apart to insure sealing engagement between the edges and ends of said blades and the surfaces defining said generally cylindrical chamber.

6. An energy converter as claimed in claim 1, wherein each slot formed in said blade carrying disc includes a sealing means for sealingly engaging the sides of a blade disposed therein, whereby the chamber zone defined to one side of said blade carrying disc is sealed from the chamber zone defined to the other side of said blade carrying disc.

7. An energy converter as claimed in claim 1, wherein axial grooves are formed in the cylindrical surface of said shaft to operatively receive the inner edges of said blades.

8. An energy converter as claimed in claim 7, wherein said blades are formed with extensions projecting beyond said ends of said blades and into generally central recesses formed in said profiled chamber end walls.

9. An energy converter as claimed in claim 8, including sealing means disposed in said central recesses of said profiled chamber end walls for sealing said extensions of said blades with respect thereto.

10. An energy converter as claimed in claim 7, including sealing means for sealing the clearance between the surfaces defining said axial grooves in said shaft and the sides of the blade portions disposed within said grooves.

11. An energy converter as claimed in claim 7, including means for urging the outer edge of said blades into sealing engagement with the cylindrical surface defining said generally cylindrical chamber.

12. An energy converter as claimed in claim 2, including a plurality of peaks formed on each said cylindrical end wall profile and an equal number of valleys, the number of said blades equaling the number of said peaks and an inlet port and an outlet port being provided to the chamber zone defined between adjacent peaks.

* * * * *